United States Patent [19]

Taylor

[11] Patent Number: 4,723,292

[45] Date of Patent: Feb. 2, 1988

[54] VOICE EVACUATION SYSTEM

[75] Inventor: George H. Taylor, Westford, Mass.

[73] Assignee: Reen Corporation, Westford, Mass.

[21] Appl. No.: 900,985

[22] Filed: Aug. 27, 1986

[51] Int. Cl.[4] ..... H04R 29/00

[52] U.S. Cl. ..... 381/56; 381/55; 381/82

[58] Field of Search ..... 381/55, 56, 58, 59, 381/82, 84; 330/10, 207 P, 298; 370/9

[56] References Cited

U.S. PATENT DOCUMENTS

| | | | |
|---|---|---|---|
| 3,976,955 | 8/1976 | Hamada | 330/207 P |
| 3,989,908 | 11/1976 | Budrys et al. | 381/58 |
| 4,047,120 | 9/1977 | Lord et al. | 330/207 P |
| 4,167,710 | 9/1979 | Suzuki et al. | 330/207 P |
| 4,173,739 | 11/1979 | Yoshida | 330/207 P |
| 4,415,863 | 11/1983 | Tokumo | 330/298 |
| 4,481,660 | 11/1984 | De Koning et al. | 381/58 |
| 4,509,101 | 4/1985 | Kenji | 330/10 |
| 4,531,096 | 7/1985 | Yokoyama | 330/10 |

FOREIGN PATENT DOCUMENTS

| | | | |
|---|---|---|---|
| 58-219898 | 12/1983 | Japan | 381/55 |
| 59-230396 | 12/1984 | Japan | 381/55 |

*Primary Examiner*—Forester W. Isen

*Attorney, Agent, or Firm*—E. T. Barrett

[57] ABSTRACT

A voice evacuation system using pulse width modulation of square waves at a frequency substantially higher than the voice signals. A number of amplifiers are connected in parallel to the distribution circuit. The signal from each amplifier is examined for the presence of the square waves. If no square waves are present, the amplifier is automatically disconnected from the distribution circuit. The remaining amplifiers are of sufficient capacity to carry the required load. The high frequency components are flitered from the signal before it is applied to the distribution circuit, leaving only the audio signals.

Because of the nature of the coupling to the distribution circuit, a monitoring voltage and signals to operate auxiliary devices may be applied to the distribution circuit for supervision and operation of the auxiliary devices during actual operating conditions. The monitoring d-c voltage is applied through a resistor to the distribution circuit, which is terminated by a resistor, and the voltage on the distribution circuit is monitored to determine the condition of operation of the circuit. Operation of the auxiliary devices is unaffected by the presence of the monitoring voltage because of the polarity of that voltage and rectifiers in the auxiliary device circuits.

26 Claims, 3 Drawing Figures

VOICE EVACUATION SYSTEM

BACKGROUND OF THE INVENTION

1. Field of the Invention

This invention relates to audio systems of the kind used in commercial and other large structures and more particularly to such a voice evacuation system readily adapted for multiple additional uses such as paging, background music etc.

2. Brief Description of the Prior Art

In voice evacuation systems, it is important to provide for continuous monitoring to insure the system is at all times in operating condition. Such monitoring requires continual testing of the amplifiers in the system and a supervisory alarm system to maintain a continuing check on the condition of the distribution circuits.

In the usual system, the output from a conventional audio amplifier is connected to a distribution circuit that includes a number of loudspeakers appropriately positioned to disseminate the desired instructions in the event of an emergency. One or more back-up amplifiers are provided and are arranged to be substituted for the main amplifier in the event of its failure.

To be certain of the proper functioning of th amplifiers, it is necessary to operate the amplifiers continuously, even when no emergency is present. It is also important to be certain of the operation during a power outage when the amplifiers must be operated from a back-up power supply. Because of the heavy power drain of the amplifiers during this period, large and expensive battery supplies are usually required.

In the event of failure of the main power amplifier, relay circuits substitute a back-up amplifier. This requires that each back-up amplifier have power capabilities equal to that of the main amplifier.

To supervise the operation of the distribution circuit, it is usual to disconnect the distribution circuits from the amplifiers and connect a monitoring voltage to the distribution circuit. An alarm is sounded if the distribution circuits are either open or short-circuited. Because of the limitations of the signal coupling, a direct monitoring voltage cannot be superimposed on the distribution circuit. The result is that the supervisory circuit is inoperative when the amplifiers are connected to the distribution circuits. This is a substantial difficulty because the most critical time for determining the proper operation of the distribution circuits is during an actual emergency.

This same limitation makes it necessary for any emergency lighting, signaling or control system, such as a series of lights, audible devices or other auxiliary controls, to be handled by a separate circuit.

SUMMARY OF THE INVENTION

The audio signal to be distributed is applied to a pulse width modulator to produce a higher frequency signal having a pulse width that is a function of the amplitude of the audio signal. This signal is passed through an amplifier whose output is immune to artificially imposed a-c or d-c levels.

Generally, several such amplifiers are connected in parallel, an arrangement which is not possible with the currently existing systems. Each amplifier is provided with a self-checking circuit that is arranged to disconnect the output of that amplifier in the event of its improper operation. This arrangement requires less total amplifier capacity for back-up purposes. For example, assume four amplifiers are connected in parallel in a system requiring 1200 watts of output power. Each amplifier will be capable of handling 400 watts. During normal operation, with all four amplifiers operating, each amplifier will be handling a load of three hundred watts. If one of the amplifiers should fail, even during actual emergency conditions, it will immediately disconnect itself from the distribution circuits while the other three amplifiers will continue normal operations with each of the amplifiers handling a load of four hundred watts. In the conventional arrangement, where the amplifiers are not connected in parallel, it would be necessary to provide a back-up amplifier system capable of handling the entire 1200 watts.

Under standby conditions it is not necessary to maintain the operation of the amplifiers, because a defective amplifier will immediately disconnect itself under actual emergency conditions. This significantly reduces the required capacity of a battery back-up supply.

Because with this system it is possible to superimpose a monitoring signal voltage on the distribution circuit, the operation of the distribution circuit is monitored continuously even during emergency conditions. Moreover, other emergency devices requiring d-c power sources may be connected directly to the distribution circuits. Such an arrangement eliminates the need for a separate circuit to handle emergency lights, audible devices or other auxiliary controls.

DESCRIPTION OF THE PREFERRED EMBODIMENT

Figure 1:
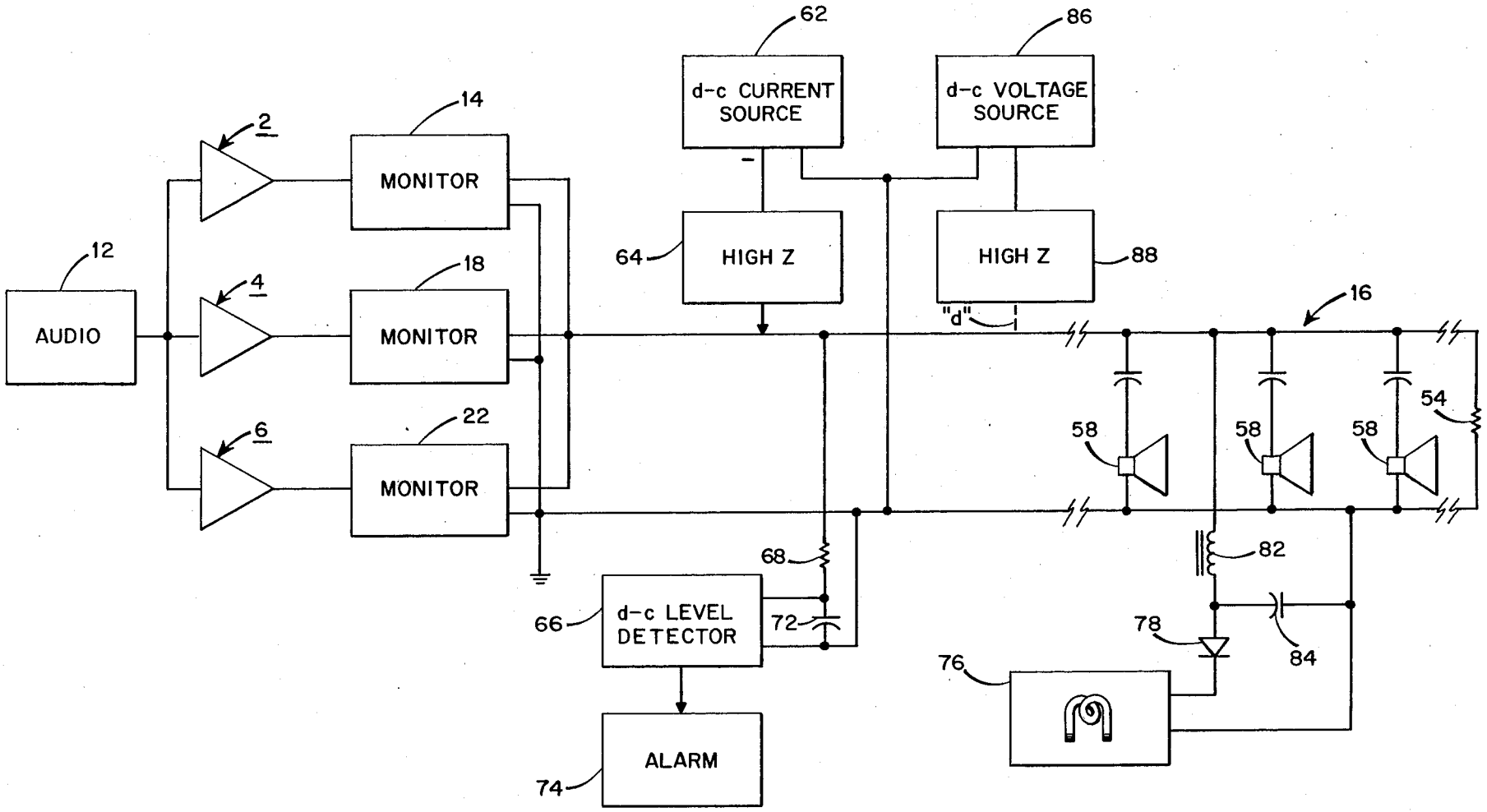
FIG. 1 shows a block diagram of a system incorporating the invention.

As shown in FIG. 1, three amplifier assemblies, generally indicated at 2, 4 and 6, have input circuits connected in parallel to an audio signal source 12. The output circuit of the amplifier assembly 2 is connected through a monitor circuit 14 to a distribution circuit, generally indicated at 16. The amplifiers 4 and 6 are similarly connected through monitor circuits 18 and 22, respectively, to the distribution circuit 16.

Figure 2:
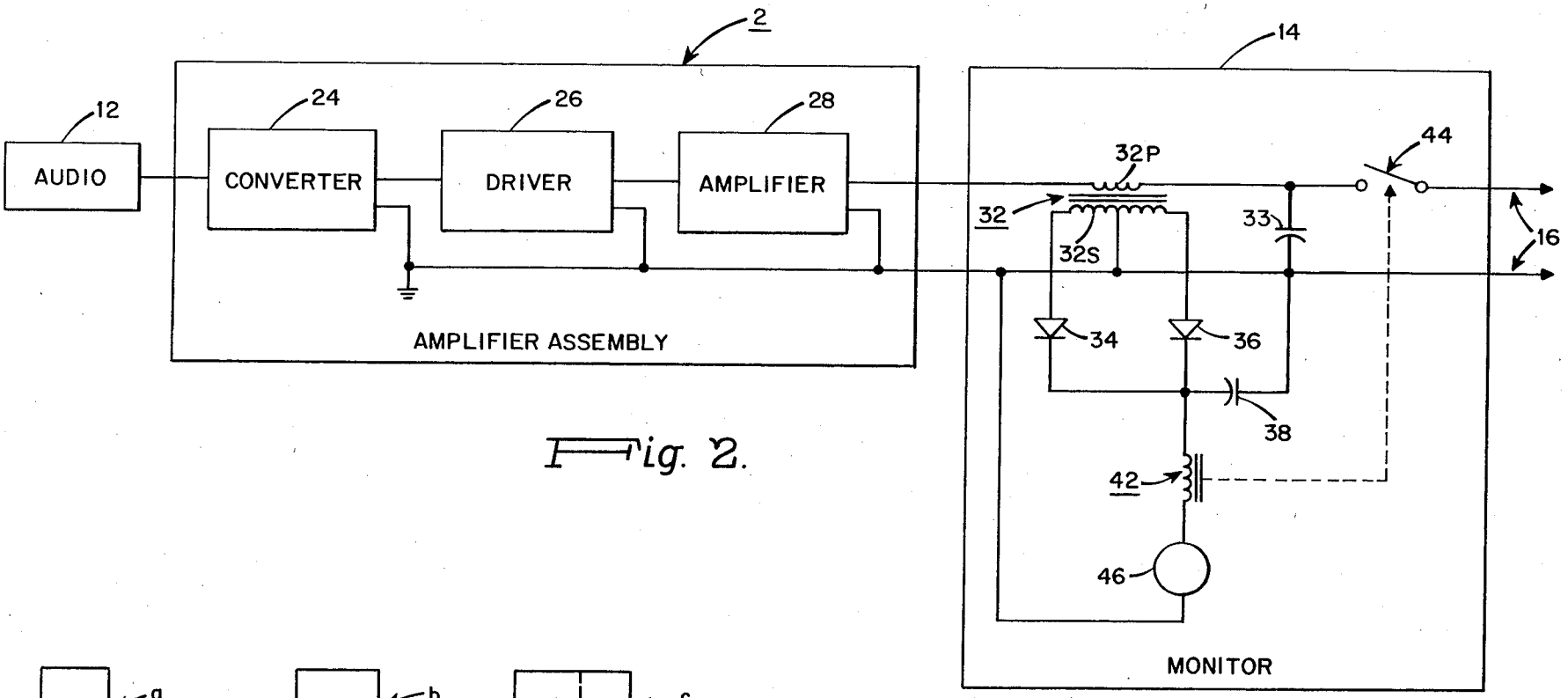
FIG. 2 illustrates diagrammatically the components of one of the amplifier assemblies and its associated monitor.
Figure 3:
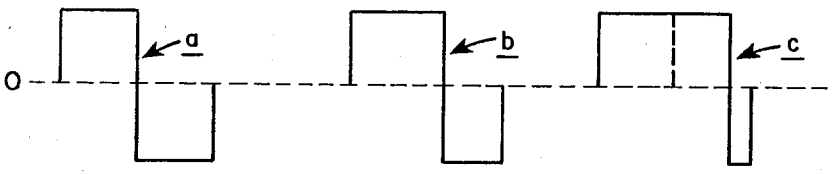
FIG. 3 shows a series of square wave pulses illustrating the method of modulation by the audio signals.

The components of the amplifier assembly 2 are shown in FIG. 2. The audio signals are applied to a converter circuit 24 which generates and modulates a series of square waves. The square waves are generated at a frequency, for example, approximately equal to 10 or 20 times the mid-frequency of the audio signals to be handled. In this example the frequency of the square waves is 144 kHz. When no input signal is applied, the positive and negative halves of the square pulse are identical, except for polarity, as indicated by curve "a" in FIG. 3, and no net d-c component is produced. When a signal is applied, the width of the pulse is modulated to increase the duration of the positive portion of the pulse and cause a corresponding decrease in the width of the negative portion of the pulse, as illustrated by curve "b" in FIG. 3. Under these conditions, a net voltage component is generated by the pulse. A further increase in the amplitude of the applied signal, as illustrated by curve "c" in FIG. 3, causes a further widening of the positive part of the square pulse and a corresponding diminution of the negative portion, generating a greater net voltage component, as illustrated by curve "c" in FIG. 3. The asymmetrical width variation of a series of the square waves is a representation of the frequency of the incoming audio signal.

The signal from the converter 24 is fed through a switch-mode driver 26 and a switch-mode amplifier 28 to the monitor 14. Within the monitor 14 an inductance 32*p* and a capacitor 33 form a low-pass filter to remove the higher frequency components resulting in amplified audio signals. The inductive winding 32*p* also forms the primary of a transformer, generally indicated at 32 and, extracts a small portion of the signal into a secondary winding 32*s* which has a center tap which may be connected to the common ground circuit. The signals produoed by the two halves of the winding 32*s* are rectified by rectifiers 34 and 36, combined and filtered by a capacitor 38. The resulting d-c signal is applied to any desired circuit interruption device, illustated in this example as a normally-open relay, diagrammatically illustrated at 42 and 44. So long as a signal is present in the primary 32*p* of the transformer 32, a pair of relay contacts 44 remain closed allowing the signal from the amplifier 28 to be applied to the distribution circuit 16.

If the amplifier 28 fails to function properly and no signal is present at the transformer 32, the relay contacts 44 open, disconnecting the amplifier from the distribution circuit 16. The load is then picked up and distributed between the other two amplifier assemblies 4 and 6. A visual indicator, which may be a light-emitting diode 46, or other device, is actuated by the same circuit that controls the relay 42 to provide either a visual or audible indication that the amplifier assembly 2 has failed The combined signals from the amplifier assemblies 2, 4 and 6 (FIG. 1), or any two of the amplifier assemblies in the event one of them has failed, is passed to the distribution circuit 16. The distribution circuit is terminated, in the usual manner, by a termination resistor 54. A number of loud speakers 58, capacitively coupled to the distribution circuit 16, are positioned in appropriate locations to provide voice evacuation information.

To provide supervision of the distribution circuit 16, a d-c current source 62 is connected through a high-impedance isolation circuit 64, which has a relatively low d-c resistance but a high impedance to the audio signals. This circuit superimposes a d-c control voltage on the distribution circuit 16. In the event the distribution circuit 16 is broken, that is, presents an open circuit, the voltage on the distribution circuit increases because current no longer flows through the termination resistor 54. This increase in voltage is detected by a d-c level detector 66. The d-c level detector is connected to the distribution line through a resistor 68 and to the common ground circuit through a capacitor 72. The resistor 68 and the capacitor represent a relatively long time constant, for example, 3 to 5 seconds. If the voltage at the d-c level detector increases above a predetermined level, an alarm 74 is actuated to indicate the open circuit condition in the distribution circuit 16.

In the event the distribution circuit is short-circuited, the increased current flow through the impedance 64 lowers the voltage on the distribution circuit. The d-c level detector 66 determines that the voltage is below a predetermined value and actuates the alarm 74 to indicate the short-circuit condition of the distribution circuit 16.

Lights, audible signals or other auxiliary controls may be connected to the distribution circuit 16 to provide notification or controls. A conventional strobe light, for example a capacitive discharge circuit using a Xenon flash lamp, indicated diagrammatically at 76, is connected through a rectifier 78 and an L-C filter, comprising a series inductor 82 and a parallel capacitor 84, to the distribution circuit 16. The voltage from a source 86, connected to the distribution circuit 16 through a high impedance device 88, charges the capacitor (not shown) in the strobe indicator 76 to produce the flashing indication.

Interference between the operation of the circuit for monitoring the distribution circuit, energized by the current source 62, and the operation of the auxiliary attachments, such as the strobe lights 76, powered by the source 86, can be prevented in a number of ways. In this example, the current source 62 applies a negative voltage to the distribution circuit 16. This voltage does not actuate the strobe light circuits because of the rectifiers 78 that do not transmit the negative current flow. When the voltage source 86 is connected to the distribution circuit 16, by completing the circuit connection indicated by the broken line "d", the d-c level detector 66 may be disabled or the computer circuits, or other controlling devices, may be programmed to ignore the alarm 74 whenever the circuit "d" is completed.

In the example shown, Class B wiring has been shown. It will be apparent to those familiar with this industry that Class A wiring, in which the termination resistor 56 is located in the area of the amplifiers 2, 4 and 6, can be used.

I claim:

1. The method of voice evacuation comprising the steps of providing an audio signal, generating a square waveform having a repetition frequency substantially higher than the frequency of said audio signal, modulating said waveform in accordance with said audio signal, providing a plurality of amplifier assemblies, connecting the amplifier assemblies in parallel, simultaneously amplifying said modulated waveforms in each of said amplifier assemblies, providing a distribution circuit having a plurality of loud-speakers, providing coupling means coupling said amplified signal to said distribution circuit, and rendering said coupling means inoperative in response to the to the absence of the repetition frequency fo said waveform from said amplified signal.

2. The method as claimed in claim 1 including the step of filtering said amplified signal prior to coupling it to said distribution circuit to eliminate said waveform therefrom while permitting coupling of said audio signal.

3. The method as claimed in claim 1 wherein the width of said waveform is modulated in accordance with amplitude of said audio signal.

4. The method as claimed in claim 3 including the steps of monitoring said amplified signal by inductively deriving a sample of said signal, rectifying said signal, filtering said signal to produce a voltage having an amplitude greater than a predetermined value, and disconnecting said distribution circuit from the amplified signal when the amplitude of said voltage is below said predetermined value.

5. The method as claimed in claim 4 including the steps of providing an alarm, and actuating said alarm in the absence of said waveform from said amplified signal.

6. The method as claimed in claim 4 wherein said signal is rectified by a full wave rectifier.

7. The method as claimed in claim 1 including the steps of providing a source of d-c voltage, coupling said voltage to said distribution circuit through a predetermined impedance, and monitoring the d-c voltage level on said distribution circuit to detect circuit discontinuities

8. The method as claimed in claim 7 including the steps of providing an alarm, and actuating said alarm when the level of said d-c voltage on said distribution circuit is lower than a predetermined value.

9. The method as claimed in claim 7 including the steps of providing an alarm, actuating said alarm when the level of said d-c voltage on said distribution circuit is higher than a predetermined value.

10. The method as claimed in claim 7 including the steps of providing an alarm, actuating said alarm when the level of said d-c voltage is either lower than a first predetermined value or higher than a second predetermined value.

11. The method of voice evacuation including the steps of:

providing a source of audio signals, providing modulation means for pulse-width modulation including means generating successive symmetrical waveforms having a predetermined repetition frequency, modulating the width of said waveforms in accordance with the amplitude of said audio signals, providing an amplifier means for amplifying said modulated signals, providing coupling means coupling the output from said modulation means to said amplifier means.

providing a distribution circuit having a plurality of means for generating audible signals, coupling the output from said amplifier means to said distribution circuit, monitoring the output of said amplifier means for the presence of said repetition frequency, and in response to the absence of the repetition frequency of said waveforms in the output from said amplifier means, rendering said coupling means inoperative.

12. The method as claimed in claim 11 including the steps of providing a plurality of amplifiers as said amplifier means for amplifying said modulated signals, providing coupling means for each of said amplifiers coupling the outputs thereof in parallel to said distribution circuit, independently monitoring the output of each of said amplifiers for the presence of the repetition frequency of said waveforms, and in the absence of the repetition frequency of said waveforms in the output from any one of said amplifiers, rendering inoperative the individual coupling means for that particular amplifier.

13. The method as claimed in claim 11 including the steps of generating a d-c voltage of predetermined magnitude, coupling said voltage to said distribution circuit through a predetermined impedance, monitoring the level of said d-c voltage on said distribution circuit, and actuating an alarm in response to variation of said voltage beyond a predetermined limit.

14. In an alarm system, the combination comprising means for producing an audio signal, modulation means including means for producing a waveform at a repetition frequency substantially higher than the frequency of said audio signal, and means for modulating said waveform in accordance with the instantaneous amplitude of said audio signal, amplifier means for amplifying said modulated waveform, distribution circuit means including a plurality of audible signal generators, means coupling the output of said amplifier means to said distirbution circuit means, monitoring means coupled to the output of said amplifier means for detecting the presence of the repetition frequency of said waveform, and switch means under the control of said monitoring means for disconnecting said distribution circuit means from said amplifier means in the absence of the repetition frequency of said waveform.

15. Apparatus as claimed in claim 14 including filtering means interposed between said amplifier means and said distribution circuit means for removing said waveform frequencies and passing said audio signal.

16. Apparatus as claimed in claim 14 wherein said monitoring means includes means for inductively obtaining a sample of said amplified signal, rectifier means for rectifying said sample, and filter means for removing higher frequency components from said sample.

17. Apparatus as claimed in claim 14 including alarm means, and means for actuating said alarm in the absence of the repetition frequency of said waveform from said amplified signal.

18. Apparatus as claimed in claim 14 including said amplifier means comprises a plurality of amplifiers, and means connecting the outputs of said amplifiers in parallel, and wherein said monitoring means includes means for independently detecting the presence of the repetition frequency of said waveform in the output of each of said amplifiers, and said switch means includes means for independently disconnecting the output of any of said ampifiers from said distribution circuit means in the absence of the repetition frequency of said waveform in the output of said any one of said amplifiers.

19. Apparatus as claimed in claim 14 including
a d-c voltage source,
means coupling said source to said distribution circuit means, and
d-c level detection means for monitoring the d-c voltage level of said distribution circuit means, thereby to detect circuit discontinuities.

20. Apparatus as claimed in claim 14 including
alarm means, and
actuating means for actuating said alarm means when the level of said d-c voltage on said distribution circuit means is lower that a predetermined value.

21. Apparatus as claimed in claim 19 including
alarm means, and
actuating means for actuating said alarm means when the level of d-c voltage on said distribution circuit means is higher than a predetermined value.

22. Apparatus as claimed in claim 19 including
alarm means, and
actuating means for actuating said alarm means when the level of said d-c voltage is either lower than or a first predetermined value or higher than a second predetermined value.

23. In an alarm system, the combination:
a source of audio signal,
modulation means coupled to said source for pulse-width modulation, including
means for generating square waveforms having a predetermined repetition frequency, and
means for modulating the width of said waveforms in accordance with the amplitude of said audio signal,
an amplifier means connected to the output of said modulation means,
a distribution circuit including a plurality of means for producing audible signals,
coupling means coupling the output from said amplifier means to said distribution circuit,
monitoring means coupled to said amplifier means for detecting the presence of the repetition frequency of said waveform, and
switch means under the control of said monitoring means for rendering said coupling means inoperative in the absence of the repetition frequency of said waveforms from amplifier signal with the output of said amplifier means.

24. Apparatus as claimed in claim 23 including said amplifier means comprises a plurality of amplifiers, and
means connecting the outputs of said amplifiers in parallel,
said monitoring means including means for independently detecting the presence of the repetition frequency of said waveforms in the output of each of said amplifiers, and
said switch means including means for selectively disconnecting any one of said amplifiers from said distribution circuit in response to the absence of the repetition frequency of said waveforms from the output of said any of said amplifiers.

25. Apparatus as claimed in claim 23 including
signalling means comprising
a source of d-c voltage,
a plurality of auxiliary devices connected to said distribution means and responsive to said d-c voltage, and
control means for connecting said source to said distribution circuit thereby to actuate said devices.

26. Apparatus as claimed in claim 25 including
a d-c current source connected to said distribution circuit and having a polarity opposite from that of said voltage source,
rectifier means associated with said auxiliary devices for preventing flow of said current from said d-c current source through said auxiliary devices,
alarm means, and
actuating means for actuating said alarm means when the level of d-c voltage on said distribution circuit is outside predetermined limits.

* * * * *